United States Patent [19]

White

[11] 4,007,399

[45] Feb. 8, 1977

[54] FLASHING CIRCUITRY

[75] Inventor: Roby B. White, Cumberland, R.I.

[73] Assignee: W. H. Brady Co., Milwaukee, Wis.

[22] Filed: June 5, 1975

[21] Appl. No.: 584,041

[52] U.S. Cl. ..... 315/241 R; 315/200 A; 315/234; 315/240

[51] Int. Cl.[2] ..... H05B 41/34

[58] Field of Search ..... 315/200 A, 202, 238, 315/240, 241 R, 241 P, 227 R, 234, 237

[56] References Cited

UNITED STATES PATENTS

| | | | |
|---|---|---|---|
| 3,585,444 | 6/1971 | Crowley | 315/240 |
| 3,767,969 | 10/1973 | White | 315/200 A |

*Primary Examiner*—Eugene La Roche

[57] ABSTRACT

Electrical circuitry for delivering to a flashtube a series of flash-producing electrical pulses, the circuitry comprising energy circuitry means for repeatedly storing electrical energy and discharging the energy in the form of such pulses through the flashtube, each pulse producing a flash, each flash being grouped in a flash cycle synchronized with a cycle of an AC voltage source, the energy circuitry means comprising first and second capacitors connected by a switching element responsive to the difference between a first voltage at the junction between the first capacitor and the switching element and a second voltage on the second capacitor, the energy circuitry means stepping up the voltage discharged across the flashtube by the second capacitor, and firing circuitry means for receiving during each flash cycle a portion of the energy discharged by the energy circuitry means, to initiate each flash, the firing circuitry means being timed to initiate the flash, thereby reducing the second voltage upon discharge of the second capacitor, at a time during the period when the first voltage is below the value of the extinction voltage of the flashtube, so that the switching element remains off during the flash and the flashtube is thereby isolated from the first capacitor during the flash.

4 Claims, 3 Drawing Figures

FIG 1
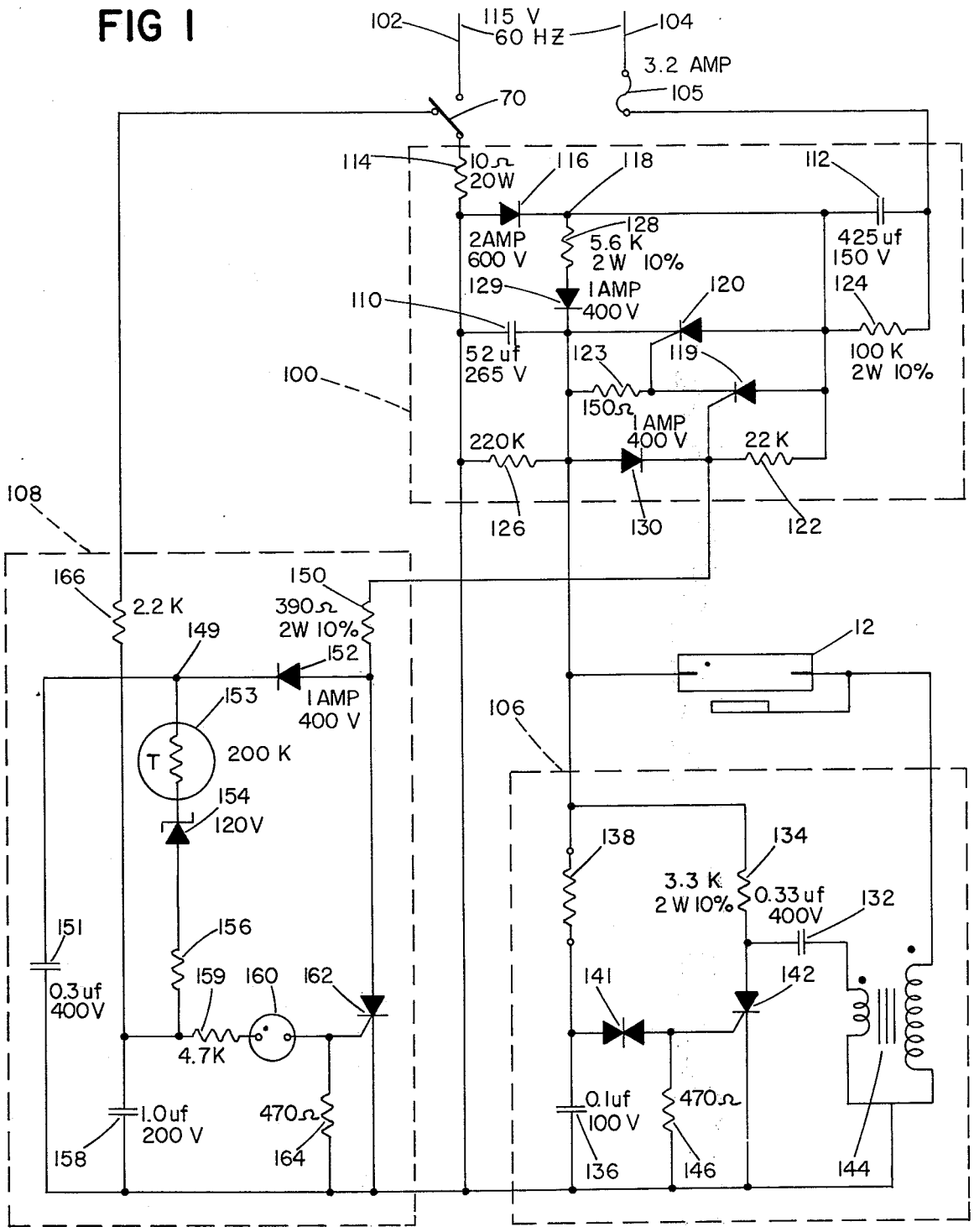
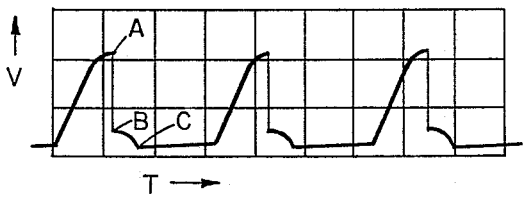
FIG 2
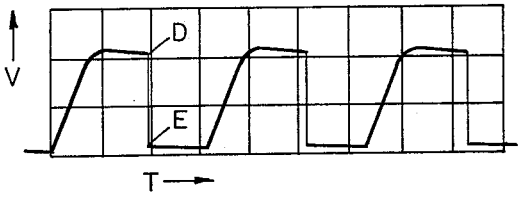
FIG 3

FLASHING CIRCUITRY

BACKGROUND OF THE INVENTION

This invention relates to delivering a series of flash-producing electrical pulses to a flashtube in rapid succession, and provides an improvement in certain respects in the circuitry disclosed in U.S. Pat. No. 3,767,969.

When a high ultraviolet flashtube output is desired, slow discharges through the flashtube at low voltage producing a low percentage of ultraviolet light, a high percentage of infrared light, and consequent unwanted heat are to be avoided.

SUMMARY OF THE INVENTION

The invention provides circuitry capable of delivering a series of flash-producing electrical pulses to a flashtube to cause the flashtube to produce a high percentage of ultraviolet light, a low percentage of infrared light, and consequently a low amount of heating throughout the duration of each flash, with a minimum of circuit elements. Less heat is given off than in the circuitry of U.S. Pat. No. 3,767,969, and in particular the flashtube and power resistor carry less current and run cooler than those of the reference patent, making the circuitry safer and prolonging component life.

The invention features electrical circuitry for delivering to a flashtube a series of flash-producing electrical pulses comprising energy circuitry means for repeatedly storing electrical energy from an AC voltage source and discharging the energy in the form of such pulses through the flashtube, each of such pulses producing a flash, each such flash being grouped in a flash cycle synchronized with a cycle of the source, the energy circuitry means comprising a first capacitor connected to store the energy from the source, a second capacitor connected to discharge a first portion of the energy through the flashtube, in a flash-producing pulse, and a switching element connected between the first and second capacitors, the energy circuitry means generating two voltages, a first voltage at the junction between the first capacitor and the switching element, the first voltage rising and falling with the AC source, and a second voltage on the second capacitor, the switching element being in the on condition when the first voltage is greater than the second voltage and being in the off condition when the second voltage is greater than the first voltage, the switching element, when in the on condition, permitting the energy to flow from the first capacitor to the second capacitor to charge up the second capacitor to a higher voltage than the voltage of the source, and the switching element, when in the off condition, isolating the first capacitor from the second capacitor and the flashtube, firing circuitry means for receiving during each such flash cycle a second portion of the energy discharged by the energy circuitry means, to initiate each flash, the firing circuitry means initiating each flash by discharging through the flashtube, thereby enabling the second capacitor to discharge through the flashtube to produce each flash, the switching element being in the off condition at the time of the initiating, and the firing circuitry means being timed to initiate each flash, and thereby reduce the second voltage upon discharge of the second capacitor through the flashtube, at a time during the period when the first voltage is below the value of the extinction voltage of the flashtube, so that the switching element remains in the off condition during each flash and the flashtube is thereby isolated from the first capacitor during each flash.

Preferred embodiments feature firing circuitry means comprising a resistor and a third capacitor in series, the resistor and third capacitor having a time constant which determines the time of initiating of each flash to be during the period when the first voltage is below the extinction voltage; and a time constant of the resistor and third capacitor from 0.075 to 0.11 second.

Other advantages and features of the invention will be apparent from the description and drawings herein of a preferred embodiment thereof.

BRIEF DESCRIPTION OF THE DRAWINGS

FIG. 1 is a schematic drawing of electrical circuitry for pulsing the flashtube;

FIG. 2 is a voltage-time plot of the voltage across capacitor 110 of FIG. 4 of U.S. Pat. No. 3,767,969; and FIG. 3 is a voltage-time plot of the voltage across capacitor 110 of FIG. 1 of the present invention.

DESCRIPTION OF THE PREFERRED EMBODIMENT

Label making apparatus is shown in U.S. Pat. No. 3,767,969, incorporated by reference herein, in which a circular master stencil is mounted between a xenon arc flashtube and a cartridge of ultraviolet imaging tape.

Improved electrical circuitry for actuating the flashtube is shown in FIG. 1, and in general consists of main energy circuitry 100 for providing a series of flashes, timed in accordance with the frequency of the AC line current applied through lines 102 and 104, firing circuitry 106 for firing the flashtube under the control of circuitry 100, and total cycle timing circuitry 108 for terminating the series of flashes after the flashtube has fired the desired number of times. In the circuitry shown, all resistors are ½ watt, 10% unless otherwise noted.

In energy circuitry 100, electrolytic capacitor 110 (52 uf) is charged during each AC cycle, and provides the energy to trigger circuit 106. In particular, when switch 70 (single pole double throw, shown in the deenergized position in FIG. 1) is depressed, line current charges capacitor 112 (425 uf) to near peak line voltage through resistor 114 (10 ohms) and diode 116 during the first quarter of the AC cycle. Slow-blowing fuse 105 is connected into line 104 for safety purposes. During the second and third quarters of the AC cycle, the voltage at junction 118 rises to approximately twice peak voltage (the sum of the reversed line voltage and that already present across capacitor 112), SCR 119 is turned on (a gate current being supplied through 22K resistor 122), causing a strong gate current to turn on SCR 120 solidly, and a portion of the charge on capacitor 112 transfers to capacitor 110 (the ratio of voltages of the two capacitors being in inverse proportion to the ratio of capacitances, so that the smaller capacitor 110 will be charged to above peak line voltage). Resistor 123 (150 ohms) prevents false firing of SCR 120. Resistors 124 (100K) and 126 (220K) are bleed resistors to discharge capacitors 112 and 110 for safety purposes when the unit is turned off. Resistor 128 (5.6K), diode 129, and diode 130 work in conjunction with circuitry 106 and 108 as described below.

When rising voltage on capacitor 110 is sufficiently higher than that at junction 118, the latter dropping with the AC cycle, SCRs 119 and 120 turn off. They are kept off by the negative voltage maintained at the gate of SCR 119 by diode 130, a result of current flowing from capacitor 112 through resistor 128, diode 129, and diode 130 into circuit 108, as more fully described below. Diode 129 prevents unwanted backward discharge of capacitor 110 through resistor 128 into capacitor 112.

While capacitor 110 is being charged as just described, it in turn charges, in circuitry 106, capacitor 132 (0.33 uf) through resistor 134 (3.3K), and capacitor 136 (0.1 uf) through resistor 138 (chosen to give the desired charging rate of capacitor 136 as described below). When charged to approximately 26 volts, capacitor 136 fires trigger diode 141, turning on SCR 142. As a result, capacitor 132 discharges into the primary of step-up transformer 144. The voltage across the transformer secondary then fires flashtube 12, making the flashtube conductive and thus permitting capacitor 110 to discharge through it, causing a flash to occur. The current through the flashtube causes SCR 142 to be reset. Ground reference resistor 146 (470 ohms) prevents false firing of SCR 142.

When SCRs 119 and 120 turn off, and diode 130 is conductive, as above described, current flows through diode 130 to circuitry 108, and there through resistor 150 (390 ohms) and diode 152 to charge up capacitor 151 (0.3 uf) to the voltage on capacitor 110. Diode 152 prevents discharge of capacitor 151 through resistors 150, 122 and 124 into capacitor 112. Capacitor 151 and diode 152 together act as a peak voltage detector, capacitor 151 following the peaks of capacitor 110. Capacitor 151 thus changes what would have been a pulsating voltage applied to capacitor 158 to a relatively constant one, a voltage that is more dependent on the peak value of capacitor 110 during each cycle and less dependent on the firing time, which time may vary as the operating point of trigger diode 141 varies with age. Capacitor 151 charges capacitor 158 (1.0 uf) through thermistor 153, zener diode 154 (120 volts), and resistor 156 (220K to 1.0M, 5% the particular resistance being selected by testing to give the desired charging rate of capacitor 158, and hence the desired number of flashes per exposure). Diode 152 prevents current leak from capacitor 158 between flashes, so that the voltage across capacitor 158 increases upon each flask cycle, and eventually fires neon tube 160, turning on SCR 162 to cause discharge of capacitor 110 and to prevent further charging up of it by capacitor 112, terminating the series of flashes. Resistor 159 acts as a current limiter upon discharging of capacitor 158 through tube 160, thereby preventing burnout of SCR 162. Resistor 156 controls the rate of charge of capacitor 158, hence determining the number of flashes per exposure. Zener diode 154 provides a threshold voltage below which current will not flow to capacitor 158, so that capacitor 158 charges during only a small peak portion of each AC cycle. As a result, the charge rate of capacitor 158 is sensitive to fluctuations in line voltage, so that the number of flashes per exposure will drop as line voltage increases, such action tending to equalize total energy supplied to the flashtube per exposure.

Bead thermistor 153 compensates for the fact that, even at unchanging line voltage, more energy is delivered per flash cycle as the components, in particular the capacitors 110 and 112, warm up. The thermistor 153, which is mounted in heat transfer relationship with capacitor 110, provides decreased resistance as capacitor 110 heats up, thus charging capacitor 158 a greater amount on each flash cycle, and thus diminishing the number of flashes in a way compensating for the increased energy per flash cycle owing to temperature increase.

Resistor 164 (470 ohms) prevents false firing of SCR 162.

When switch 70 is released capacitor 158 is discharged through resistor 166 (2.2K) by the normally closed contacts of switch 70, so that the next exposure cycle will be of the same length. Resistor 166 limits the discharge current to prevent building up of discharge spikes and the consequent eventual shorting out of switch 70.

With the circuitry arrangement and parameters described in U.S. Pat. No. 3,767,969, the flash-producing discharge of capacitor 110 (FIG. 4 of the patent) through flashtube 12 occurs shortly after capacitor 110 charges to and maintains a peak value of approximately 220 volts. Discharge of capacitor 110 is very rapid until the voltage on capacitor 110 drops to a value equal to the voltage at junction 118, which is more slowly descending to follow the AC source. At this point SCR 120, having turned off shortly before, when the voltage on capacitor 110 first began to exceed that at junction 118, turns on again, permitting capacitor 112 to join capacitor 110 in discharging into flashtube 12, capacitor 112's discharge path being through power resistor 114. Voltages on the two capacitors drop at substantially the same rate (resistor 114 being responsible for a slight difference), a rate much slower than the original very rapid drop of the voltage of capacitor 110, because the capacitances of the now parallel-connected capacitors 110 and 112 add, thus presenting a total capacitance higher than that of capacitor 110, and resistor 114 provides a higher resistance discharge path than that taken by capacitor 110 alone, both factors thereby increasing the time constant for discharge. FIG. 2 shows the change in voltage of capacitor 110 as a function of time. Firing of flashtube 12 occurs at point A, followed by a very rapid discharge of capacitor 110 through flashtube 12 accompanying the flash until point B is reached, where SCR 120 turns on again as above described. Curve portion BC indicates the slowed discharge of capacitor 110, beginning at the low voltage B and producing a low percentage of ultraviolet light from flashtube 12 and a consequent high percentage of infrared and heat. At a certain base voltage C, the extinction voltage of the flashtube, flashtube 12 turns off.

In the present circuitry, firing circuitry 106 is timed to initiate the flash during the period when the voltage at junction 118 is below the value of the extinction voltage of flashtube 12. Specifically, capacitor 136 and resistor 138 are chosen to have an RC time constant such that capacitor 136 will reach the voltage needed to fire trigger diode 141 during this low period of junction 118's voltage. With capacitor 136 at 0.1 uf, the resistance of resistor 138 is selected by testing from the range of 750K to 1.1M, 5%, thereby giving a choice of time constants from 0.075 to 0.11 second, to initiate the flash during the desired period. Determining the firing time of trigger diode 141 serves to determine the firing time of flashtube 12 by the above-described sequence through SCR 142, capacitor 132, and transformer 144. By firing flashtube 12 and thus discharging capacitor 110 at a time during the period when the voltage at junction 118 is below the flashtube extinction voltage, flashtube 12 is thereby isolated from capacitor 112 during the flash. This is so because SCRs 119 and 120 will not turn on to connect capacitor 112 with flashtube 12 until the voltage on capacitor 110 falls to match the voltage at junction 118, and at this voltage flashtube 12 has already flashed and been extinguished. FIG. 3, having the same voltage and time scales as FIG. 2, illustrates the effect of what is occurring on the voltage of capacitor 110. When the flashtube firing point D is reached, markedly further to the right on the time scale than point A of FIG. 2, capacitor 110 discharges through flashtube 12 almost instantaneously down to base voltage E, the flashtube extinction voltage, corresponding to point C of FIG. 2. There is no region of slowed discharge of capacitor 110 at low voltage through flashtube 12 corresponding to sector BC of FIG. 2. The percentage of ultraviolet light emitted by the flashtube remains high throughout the flash, and the heat output is cut by 50 percent. Flashtube 12 also runs cooler because it carries less current, and power resistor 114 is much cooler to the touch.

What is claimed is:

1. A circuit for operation in conjunction with a source of alternating current to deliver a pulse rich in ultraviolet light relative to the total energy of the pulse, comprising:

a first, larger, capacitor;
a second, smaller, capacitor;
a flash tube having an extinction voltage;
a third, trigger, capacitor;
timing means;
switching means; and
a reference junction;
said first capacitor being connected to be charged by said source during a first portion of a cycle thereof, and to discharge into said second and third capacitors;
said second capacitor being connected to be charged also by said source during a second portion of a cycle thereof, and to discharge through said tube upon triggering thereof;
said trigger capacitor being discharged by said timing means, to fire said flash tube;
said reference junction having a voltage the instantaneous sum of line and that across said first capacitor;
said switching means connecting said first and second capacitors when the voltage at said reference junction exceeds the voltage at said second capacitor; and
said timing electronically reacting to discharge said trigger capacitor at a time when said reference junction has a voltage low relative to said extinction voltage.

2. The circuit of claim 1 in which said timing means electronically reacts to discharge said trigger capacitor at a time when said reference junction has a voltage below said extinction voltage.

3. The circuit of claim 2 comprising also a resistor, said resistor with said third capacitor providing a time constant constituting said timing means.

4. The circuit of claim 3 in which said time constant is from 0.075 to 0.11 second.

* * * * *